United States Patent [19]

Igarashi

[11] Patent Number: 4,483,461

[45] Date of Patent: Nov. 20, 1984

[54] FLASH-BACK ARRESTOR FOR DISSOLVED ACETYLENE CYLINDERS

[75] Inventor: Tadasu Igarashi, Yamagata, Japan

[73] Assignee: Nihon Coyne Kabushiki Kaisha, Tokyo, Japan

[21] Appl. No.: 280,282

[22] Filed: Jul. 6, 1981

[30] Foreign Application Priority Data

Dec. 25, 1980 [JP] Japan ..... 55-187299[U]

[51] Int. Cl.[3] ..... B65D 25/38; B67D 5/32

[52] U.S. Cl. ..... 222/3; 55/385 R; 55/417; 55/512; 55/DIG. 20; 55/DIG. 42; 206/0.6; 220/85 V; 220/88 A; 222/189; 222/545

[58] Field of Search ..... 220/88 A, 88 R, 85 V; 206/0.6, 0.7; 55/512, 522, DIG. 42, DIG. 20, 383 R, 417; 222/3, 189, 545; 137/544

[56] References Cited

U.S. PATENT DOCUMENTS

| | | | |
|---|---|---|---|
| 1,608,155 | 11/1926 | Barnebey | 206/0.7 |
| 1,755,624 | 4/1930 | Yount | 220/88 A X |
| 1,918,906 | 7/1933 | Grohmann | 220/88 A |
| 2,130,333 | 9/1938 | Allen | 220/85 UX |
| 2,810,631 | 10/1957 | Kanenbley | 220/88 A X |
| 3,190,496 | 6/1965 | Weiland, Jr. et al. | 222/3 |

FOREIGN PATENT DOCUMENTS

| | | | |
|---|---|---|---|
| 470386 | 9/1914 | France | 220/88 A |

OTHER PUBLICATIONS

"Porous Metal Foams" by H. A. Bray, *Filtration and Separation,* May/Jun. 1973, pp. 321–325.

*The Condensed Chemical Dictionary* (10th ed.), Revised by Gessner G. Howley, 1981, published in Canada by Van Nostrand Reinhold Ltd., p. 458.

*Primary Examiner*—Allan N. Shoap

*Attorney, Agent, or Firm*—James E. Nilles

[57] ABSTRACT

A flash-back arrestor for dissolved acetylene cylinders wherein a cylinder gas-permeable at both ends thereof is joined to an inner end of a valve body in a dissolved acetylene cylinder in such a manner that said cylinder is communicated with a gas passage in said valve body. Filter plates are provided at upper and lower portions of said cylinder, and a packing consisting of a non-combustible granular material is inserted in the portion of the interior of said cylinder which is between said filter plates.

3 Claims, 5 Drawing Figures

PRIOR ART FIG. 1
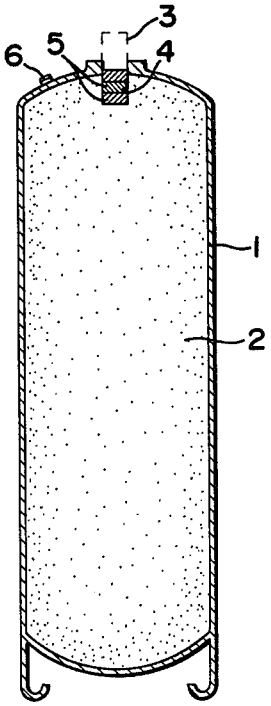
FIG. 2
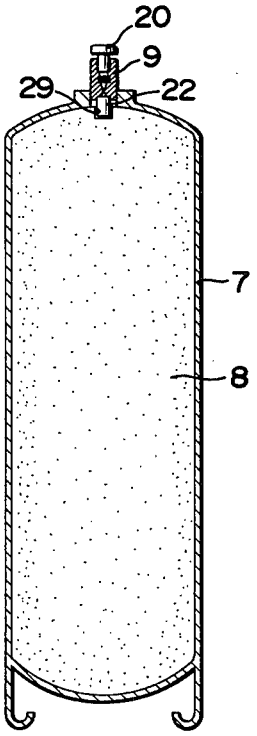

FLASH-BACK ARRESTOR FOR DISSOLVED ACETYLENE CYLINDERS

BACKGROUND OF THE INVENTION

1. Field of the Invention

This invention relates to a flash-back arrestor set in a valve body in a dissolved acetylene cylinder.

2. Description of the Prior Art

Acetylene is extremely unstable and liable to be decomposed and exploded. Therefore, acetylene is currently used for industrial purposes (welding and cutting) in the form of "dissolved acetylene", in which acetylene is stabilized with a solvent (acetone or dimethylformamide (DMF)) and a porous filling material called "mass" (calcium silicate, charcoal, or a charcoal-asbestos mixture). The General High-pressure Gas Security Rules stipulate that acetylene shall be charged into a cylinder provided therein with a porous filling material which is wetted with acetone or DMF and which has passed a porous material performance test conducted by the High-pressure Gas Security Association.

There is much room for further improvement with respect to the security of an existing dissolved acetylene cylinder. The most important problem resides in that an existing cylinder of this kind has an insufficient flash-back preventive performance. Acetylene often causes fire and explosion while it is being charged into an acetylene cylinder, and flash-back while it is being consumed in a welding or cutting operation. Under the following conditions, a safety plug provided in a dissolved acetylene cylinder may be actuated due to flash-back to result in the ejection of gas or the explosion of the cylinder.

(1) The amount of acetylene in the cylinder is unduly large.

(2) The temperature of the cylinder is high.

(3) The temperature of actuation of a safety plug, which consists of a fusible alloy, is excessively low.

(4) Air is accumulated as an impurity gas in the cylinder.

A longitudinal section of an example of a conventional dissolved acetylene cylinder is shown in FIG. 1. Referring to FIG. 1, a porous material 2 consisting of mainly calcium silicate is provided in a cylinder 1, and the porous material 2 is wetted with a solvent (acetone or DMF). Felt or animal hair 5 is packed in a recess 4 formed in that portion of the porous material 2 which is just under a valve 3 for the container 1. The felt or animal hair 5 functions mainly as a filter. When flash-back into the container 1 occurs under the above-mentioned conditions, the felt is carbonized, and the decomposition thereof progresses to cause a safety plug 6 to be actuated. This often results in the ejection of gas or the explosion of the cylinder.

Some of the accidents of flash-back into an acetylene cylinder, that have occurred lately are ascribed to the adiabatic compression of the air at the acetylene cylinder side of the interior of a pressure regulator. A flash-back arrestor now on the market is so designed that it is set at a low pressure side of a pressure regulator (at such side of a pressure regulator that is away from the acetylene cylinder). Therefore, the flash-back arrestor has no effect on the prevention of the flash-back referred to above. Furthermore, it is impossible that such a commercially available flash-back arrestor be set in each acetylene cylinder when a number of acetylene cylinders are joined together to charge them with acetylene gas in an acetylene charging factory, or when a manifold is used to discharge the acetylene gas.

SUMMARY OF THE INVENTION

An object of the present invention is to eliminate the above-mentioned drawbacks encountered in conventional flash-back arrestor for dissolved acetylene cylinders.

Another object of the present invention is to provide a flash-back arrestor for dissolved acetylene cylinders comprising a cylinder permeable to gas at both end portions thereof and filled with a non-combustible granular material, the cylinder being joined to an inner end of a valve set in the cylinder, whereby a flash-back preventative effect can be easily obtained.

To these ends, the present invention provides a flash-back arrestor for dissolved acetylene cylinders, comprising a cylinder gas-permeable at both ends thereof and joined to an inner end of a valve body in a dissolved acetylene cylinder in such a manner that the cylinder is communicated with a gas passage in the valve body, filter plates provided at upper and lower portions of the cylinder, and a packing consisting of a non-combustible granular material and inserted in that portion of the interior of the cylinder which is between the filter plates.

The above and other objects as well as advantageous features of the invention will become apparent from the following description of the preferred embodiment taken in conjunction with the accompanying drawings.

BRIEF DESCRIPTION OF THE DRAWINGS

FIG. 1 is a view in longitudinal section of a dissolved acetylene cylinder to which a conventional flash-back arrestor is applied;

FIG. 2 is a view in longitudinal section of a dissolved acetylene cylinder to which a flash-back arrestor embodying the present invention is applied;

DESCRIPTION OF THE PREFERRED EMBODIMENT

Figure 3:
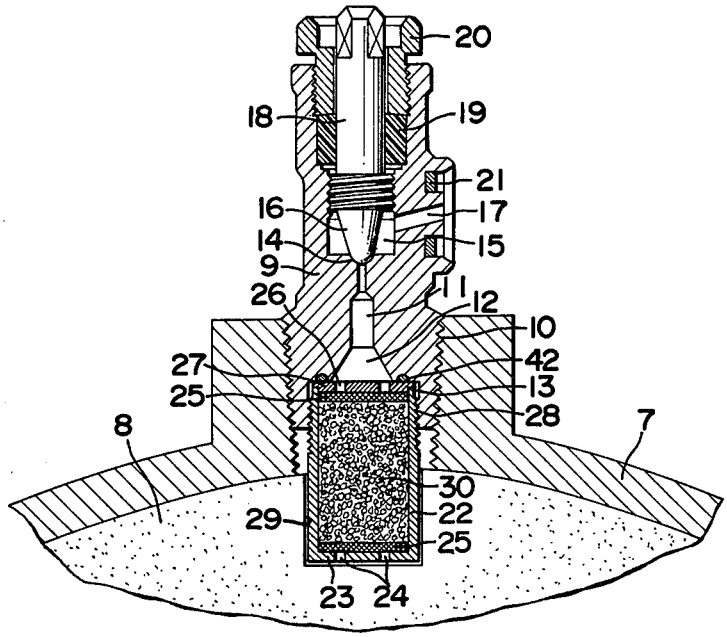
FIG. 3 is an enlarged view in longitudinal section of a valve mounting portion of the acetylene cylinder shown in FIG. 2.

The construction of an embodiment of the present invention will be described with reference to FIGS. 2 and 3.

Reference numeral 7 denotes a dissolved acetylene cylinder, and 8 a porous material consisting of calcium silicate, charcoal, or a charcoal-asbestos mixture, which is wetted with a solvent, such as acetone or DMF. Acetylene is dissolved under pressure in the solvent.

Reference numeral 9 denotes a valve body screw-connected to an open end portion of the cylinder 7 and having a gas passage 11 in the central portion thereof. The gas passage 11 diverges conically at a lower end portion thereof to form a diffusion passage 12. A cylinder fitting port 13, the diameter of which is greater than that of the diffusion passage 12, is formed between a lower end of the diffusion passage 12 and a lower end of the valve body 9. The gas passage 11 is opened at an upper end thereof into a valve chamber 15 in the valve body 9 via a valve seat 14, and adapted to be opened and closed by a needle valve 16. A charging port 17, which is opened to the outside of the valve body 9, is communicated with the valve chamber 15 at one side thereof. Reference numeral 18 denotes a spindle, 19 a gland packing, 20 a gland nut, and 21 a packing for the charging port 17.

Reference numeral 22 denotes a cylinder opened at an upper end thereof and closed at a lower end thereof with a bottom plate 23. A plurality of through bores 24 are provided in portions of the bottom plate 23 that are spaced from the center thereof. Filter plates 25, each of which consists of a wire net, asbestos, steel wool, or a metal foam, are provided at the open end portion of the cylinder 22 and on the bottom plate 23.

The metal foam is a metallic porous material having a sponge-like skeleton and a three-dimensional reticulate construction, and it has a high porosity and cavities all of which are communicated with one another. Furthermore, the metal foam has a large specific surface area and an extremely low gas-permeation resistance. The porosity of the metal foam can be regulated arbitrarily by compressing it. A metal foam having not less than 30 cells per inch and a porosity of not less than 50% is suitably used for the filter plates 25. The metal foam used for the filter plates 25 includes Ni, Ni-Cr alloy, Ni-Cr-Al alloy, Ni-Cr-Fe alloy, Fe, and Fe-Cr alloy.

A porous plate 27 is provided on the upper filter plate 25, which porous plate 27 has a plurality of through bores 26 in portions thereof that are spaced from the center thereof. The cylinder 22 is screwed at an outer circumferential surface of an upper portion thereof to a threaded inner circumferential surface 28 of the valve body 9 so as to be joined to the valve body 9. A lower portion of the cylinder 22, which projects from the lower end of the valve body 9, is fitted in a recess 29 formed in the porous material 8 provided in the cylinder 7. Reference numeral 42 denotes a gas-sealing O-ring.

Reference numeral 30 denotes a packing consisting of a non-combustible granular material inserted in the cylinder 22. The packing 30 consists of a granular material of no definite shape having a particle size of not more than 2.83 mm and not less than 0.29 mm. The following materials are used as the packing 30.

Ferrosilicon (Fe-Si alloy),
Ferrochromium (Fe-Cr alloy),
Ferromanganese (Fe-Mn alloy),
Calcium silicon (Ca-Si alloy),
Silicochromium (Si-Cr alloy).

It is practically advantageous to use ferrosilicon powder scrap obtained during the manufacture of ferrosilicon.

The operation of the above-described embodiment will now be described.

Flash-back entering the valve body 9 from the outside of the cylinder 7 is diffused in the diffusion passage 12 via the gas passage 11 and dispersed in the porous plate 27. The resulting flash-back is further dispersed in the filter plate 25 at a rate to enter spaces among the particles of the packing 30 in the cylinder 22. The heat of the flash-back entering the packing 30 is absorbed thereby, and the temperature thereof is decreased, so that the flash-back is extinguished. At this time, the granular packing 30 is crushed due to the shock of the flash-back to turn to minuter particles. Consequently, the spaces among the particles are stopped up, so that the flame stops advancing.

In order to ascertain the flash-back preventive effect of the flash-back arrestor according to the present invention, the following experiements were conducted.

Figure 5:
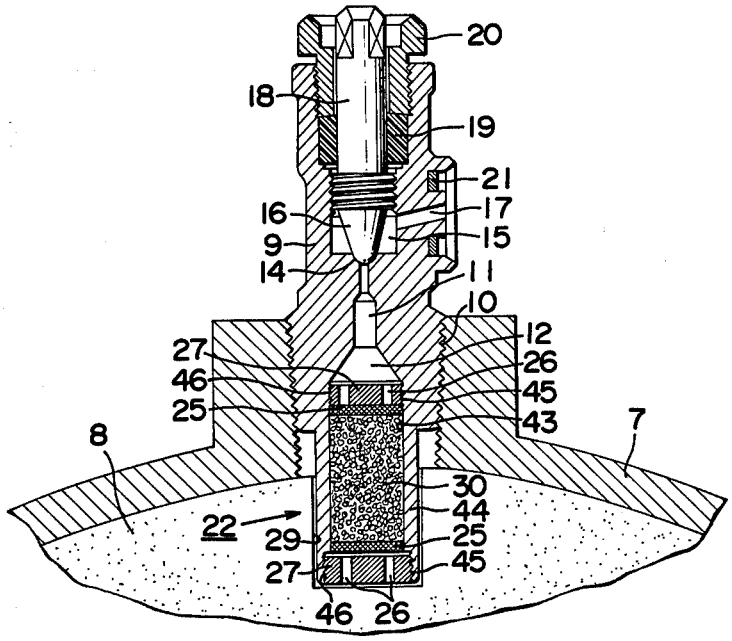
FIG. 5 is an enlarged view in longitudinal section of a valve mounting portion of the acetylene cylinder of another embodiment of the invention.

FIG. 5 shows a valve mounting portion of another embodiment of the present invention in which a cylinder 22 is formed with the valve body 9 as a unit. The cylinder 22 comprises a cylindrical portion 44 projecting from the lower surface of the valve body 9 and having an inner surface communicating with a cylindrical concave portion 43 at the underside of said valve body 9. Plates 26, 26 each having a plurality of through bores are provided at both end portions of said cylinder 22 with the threaded outer surface portions 46, 46 of the plate 26 engaging with the threaded inner surface portions 45, 45 of the cylinder 22, respectively.

Between said plates 26, 26 in the cylinder 22, a packing 30 consisting of a non-combustible granular material is inserted through filters 25, 25.

Other components and the function in this embodiment are like those of the first mentioned embodiment, so that the explanation thereof is omitted.

Figure 4:
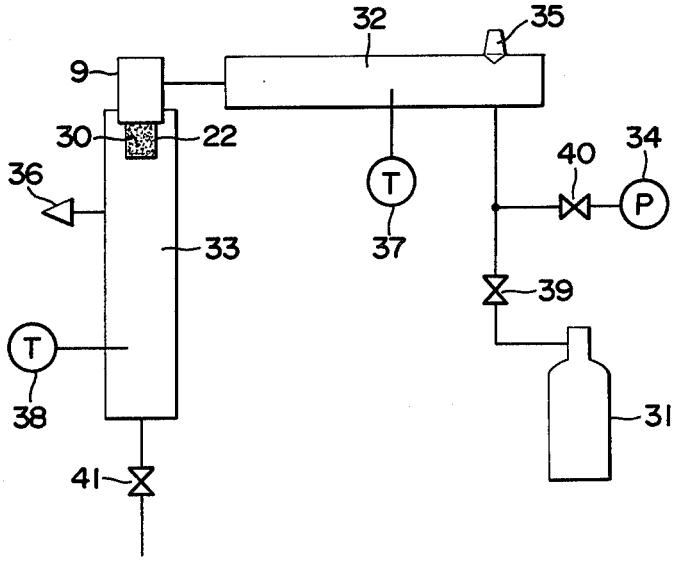
FIG. 4 is a schematic diagram of an apparatus for use in conducting experiments on the flash-back preventive effect of a flash-back arrestor.

First, an apparatus for use in conducting such experiments will be described with reference to FIG. 4.

Reference numeral 31 denotes a dissolved acetylene cylinder, 32 a flash-back tube, and 33 a measuring tube into which the valve body 9 is fitted, the cylinder 22 joined to this valve body 9 being inserted into the measuring tube 33. Reference numeral 34 denotes a Bourdon-tube type pressure gauge, 35 a platinum wire fusing type ignition plug, 36 a safety valve, 37, 38 thermocouple type thermometers, and 39, 40, 41 valves.

The following materials were used as packing 30 in the cylinder 22. Each of the materials were obtained by sieving untreated materials to separate therefrom particles having a particle size of not more than 2.83 mm and not less than 0.29 mm. The materials were placed in cylinder 22 having a capacity of approximately 16 $cm^3$.

| Sample Number | Name of Materials | Chemical Components (%) |
|---|---|---|
| 1 | Ferrosilicon | Si 75–80 (Item 2, JISG 2302) |
| 2 | " | Si 40–45 (Item 3, JISG 2302) |
| 3 | " | Si 25–30 (Item 4, JISG 2302) |
| 4 | " | Si 14–20 (Item 6, JISG 2302) |
| 5 | Ferrochromium | Cr 65–70 (Item 1, JISG 2303) |
| 6 | " | Cr 60–65 (Item 3, JISG 2303) |
| 7 | " | Cr 55–60 (Item 5, JISG 2303) |
| 8 | Ferromanganese | Mn 65–70 (Item 1, JISG 2304) |
| 9 | " | Mn 60–65 (Item 3, JISG 2304) |

The experiments were conducted in the following manner.

The degree of difficulty of stopping flash-back increases with the pressure of the acetylene gas. The General High-pressure Gas Security Rules (Ordinance of the Ministry of Trade and Industry) stipulate that a maximum charging pressure of acetylene shall be not more than 25 $kg/cm^2.G$. Even in the summer season in which the temperature is very high, the pressure in an acetylene cylinder rarely exceeds 30 $kg/cm^2.G$. Therefore, the experiments were conducted with an acetylene cylinder filled with acetylene gas at 30 $kg/cm^2.G$.

The acetylene gas in the dissolved acetylene gas cylinder 31 flows through the valve 39, flash-back tube 32, valve body 9, packing 30 in the cylinder 22 into the measuring tube 33. Thus, the measuring tube 33 is filled with the acetylene gas. The pressure in the system is measured by the pressure gauge 34 with the valve 40 opened. After the pressure in the system has reached a predetermined level (30 kg/cm$^2$.G), the valves 39, 40, 41 are closed, and the acetylene gas is ignited by the ignition plug 35. A flame formed advances through the flash-back tube 32, valve body 9, cylinder 22 into the measuring tube 33. When the flame is extinguished by the packing 30 in the cylinder 22, the acetylene in the measuring tube 33 is left undecomposed, so that the temperature in the thermometer 38 is not increased. When the flame has advanced through the cylinder 22, the acetylene in the measuring tube 33 is decomposed to generate heat, so that the temperature in the measuring tube 33 is increased suddenly. Accordingly, in order to ascertain that the advancing of the flame has been stopped by the packing 30 in the cylinder 22, the thermometer 38 was checked for a temperature rise, and the valve 41 for the measuring tube 33 was slightly opened to check by using Ilosvay reagent the gas blown from the valve 41 as to whether the gas contains acetylene gas.

The thermometer 37 was used to ascertain that the decomposition of acetylene was started in the flash-back tube 32.

The results of the experiments are shown in the following table.

| Sample number | Acetylene gas Pressure (kg/cm$^2$ · G) | Acetylene gas Purity (%) | Temperature rise (°C.) Flash-back tube T(37) | Temperature rise (°C.) Measuring tube T(38) | Reaction with Ilosvay reagent | Passage or stoppage of flash-back |
|---|---|---|---|---|---|---|
| 1 | 30 | 99.3 | 1220 | 0 | Reacted | Stopped |
| 2 | " | 99.2 | 1110 | 5 | " | " |
| 3 | " | 99.4 | 1070 | 10 | " | " |
| 4 | " | 99.3 | 1130 | 5 | " | " |
| 5 | " | 99.3 | 1000 | 10 | " | " |
| 6 | " | 99.2 | 1020 | 5 | " | " |
| 7 | " | 99.3 | 1010 | 10 | " | " |
| 8 | " | 99.4 | 1050 | 10 | " | " |
| 9 | " | 99.3 | 1030 | 10 | " | " |

The above table shows that no temperature rise (a temperature rise of 5° C.–10° C. is ascribable to the radiant heat from the flash-back tube) occurred in the measuring tube 33 and that acetylene was present in the measuring tube 33 since the content thereof reacted with the Ilosvay reagent. This means that flash-back was stopped completely in all of the samples 1–9 at a pressure of 30 kg/cm$^2$.G.

According to the present invention, a cylinder which is gas-permeable at both ends thereof is detachably fitted into an inner end portion of a valve body in a dissolved acetylene cylinder in such a manner that the cylinder is communicated with a gas passage in the valve body, and a packing consisting of a non-combustible granular material is inserted in the cylinder. Therefore, flash-back entering the acetylene cylinder can be stopped completely since the heat from the flash-back is absorbed by the packing and since the spaces among the particles of the packing are stopped up as the particles are crushed due to the shock of the flash-back. Since the cylinder filled with the packing is set in the acetylene cylinder in such a manner that the cylinder is opposed to the inner end of the gas passage in the valve body, flash-back can be prevented even when the adiabatic compression of the air occurs in a pressure regulator. The flash-back arrestor according to the present invention can be used practically by merely fitting the cylinder into the valve body, so that it can be installed in a number of acetylene cylinders easily. In fact, this flash-back arrestor can be suitably used in an acetylene charging factory, or when a manifold is used to put acetylene to practical use.

The present invention is not, of course, limited to the above-described embodiment; it may be modified in various ways within the scope of the appended claims.

What is claimed is:

1. A holder for dissolved acetylene comprising a container having a threaded opening therein and a mass of wetted porous material in the container for stabilizing acetylene charged thereinto, said holder being characterized by:

A. a valve body threadedly secured in said opening and having therein
   (1) a substantially coaxial passage portion which opens to the interior of the container,
   (2) another passage portion which is communicated with said substantially coaxial passage portion and which opens outward, and
   (3) a valve member for controlling communication between said passage portions;

B. a cylinder coaxially secured to an inner portion of said valve body and projecting therefrom a distance into the interior of the container, said cylinder defining a flash-back arrester gas passage and having opposite gas permeable end walls to permit flow of gas therethrough between the interior of the container and said substantially coaxial passage portion;

C. a filter plate in said cylinder inwardly adjacent to each of said gas-permeable end walls thereof; and D. a packing of granular material in the cylinder, between said filter plates.

2. The holder of claim 1 wherein said granular material consists of ferrosilicon.

3. The holder of claim 1 wherein each of said filter plates consists of metal foam.

* * * * *